US007752850B2

(12) United States Patent
Laster et al.

(10) Patent No.: US 7,752,850 B2
(45) Date of Patent: Jul. 13, 2010

(54) CONTROLLED PILOT OXIDIZER FOR A GAS TURBINE COMBUSTOR

(75) Inventors: Walter R. Laster, Oviedo, FL (US); Ramarao V. Bandaru, Greer, SC (US)

(73) Assignee: Siemens Energy, Inc., Orlando, FL (US)

( * ) Notice: Subject to any disclaimer, the term of this patent is extended or adjusted under 35 U.S.C. 154(b) by 801 days.

(21) Appl. No.: 11/173,655

(22) Filed: Jul. 1, 2005

(65) Prior Publication Data

US 2007/0000254 A1 Jan. 4, 2007

(51) Int. Cl.
*F02C 9/00* (2006.01)

(52) U.S. Cl. ..... 60/794; 60/39.27

(58) Field of Classification Search ..... 60/794, 60/39.27, 39.23, 39.826, 39.281
See application file for complete search history.

(56) References Cited

U.S. PATENT DOCUMENTS 4,255,927 A * 3/1981 Johnson et al. ..... 60/39.23
4,518,310 A * 5/1985 Coons ..... 415/36
4,628,687 A * 12/1986 Strom ..... 60/39.23
5,139,413 A 8/1992 Son et al.
5,218,824 A * 6/1993 Cederwall et al. ..... 60/737
5,339,620 A 8/1994 Ikeda et al.
5,365,738 A 11/1994 Etheridge
5,452,574 A * 9/1995 Cowell et al. ..... 60/39.23
5,533,329 A * 7/1996 Ohyama et al. ..... 60/773
5,617,726 A * 4/1997 Sheridan et al. ..... 60/605.2
5,755,090 A 5/1998 Hu
5,791,889 A * 8/1998 Gemmen et al. ..... 431/1
5,819,540 A * 10/1998 Massarani ..... 60/732
5,901,549 A 5/1999 Mandai et al.
5,901,555 A 5/1999 Mandai et al.
5,950,434 A 9/1999 Hums et al.
5,987,875 A 11/1999 Hilburn et al.
6,003,299 A 12/1999 Idleman
6,082,093 A 7/2000 Greenwood et al.
6,327,860 B1 12/2001 Critchley
6,415,608 B1 7/2002 Newburry
6,463,730 B1 10/2002 Keller et al.
6,625,988 B2 9/2003 Weisenstein et al.
6,679,061 B2 1/2004 Steinbach et al.
6,701,713 B2 3/2004 Mandai et al.
6,742,324 B2 6/2004 Bachelder et al.
6,848,260 B2 2/2005 North et al.
6,907,738 B1 * 6/2005 Berkeley et al. ..... 60/785
6,986,255 B2 * 1/2006 Smith et al. ..... 60/776
2001/0027639 A1 * 10/2001 Emmons ..... 60/39.06

* cited by examiner

*Primary Examiner*—Michael Cuff
*Assistant Examiner*—Andrew Nguyen

(57) ABSTRACT

A combustor (22) for a gas turbine (10) includes a main burner oxidizer flow path (34) delivering a first portion (32) of an oxidizer flow (e.g., 16) to a main burner (28) of the combustor and a pilot oxidizer flow path (38) delivering a second portion (36) of the oxidizer flow to a pilot (30) of the combustor. The combustor also includes a flow controller (42) disposed in the pilot oxidizer flow path for controlling an amount of the second portion delivered to the pilot.

23 Claims, 2 Drawing Sheets

CONTROLLED PILOT OXIDIZER FOR A GAS TURBINE COMBUSTOR

STATEMENT OF GOVERNMENT INTEREST

This invention was made with U.S. Government support through Government Contract Number DE-FC26-03NT41891 awarded by the Department of Energy, and, in accordance with the terms set forth in said contract, the U.S. Government may have certain rights in the invention.

FIELD OF THE INVENTION

This invention relates generally to gas turbines, and, in particular, to controlling an oxidizer flow to a pilot of a combustor of the gas turbine.

BACKGROUND OF THE INVENTION

The design of a gas turbine combustor is complicated by the necessity for the gas turbine to operate reliably with a low level of emissions at a variety of power levels. High power operation at high firing temperatures tends to increase the generation of oxides of nitrogen. Low power operation at lower combustion temperatures tends to increase the generation of carbon monoxide and unburned hydrocarbons due to incomplete combustion of the fuel. Under all operating conditions, it is important to ensure the stability of the flame to avoid unexpected flameout, damaging levels of acoustic vibration, and damaging flashback of the flame from the combustion chamber into the fuel premix section of the combustor. A relatively rich fuel/air mixture will improve the stability of the combustion process, but will have an adverse affect on the level of oxides of nitrogen (NOx) emissions. A careful balance must be achieved among these various constraints in order to provide a reliable engine capable of satisfying very strict modern emissions regulations. A pilot flame is commonly used to stabilize the flame over a variety of engine loading conditions.

It is known to use catalytic combustion in combustion turbine engines to reduce NOx emissions. One such catalytic combustion technique known as a rich catalytic, lean burn (RCL) combustion process includes mixing fuel with a first portion of air to form a rich fuel mixture. The rich fuel mixture is passed over a catalytic surface and mixed with a second portion of air in a downstream combustion zone to complete the combustion process. U.S. Pat. No. 6,415,608 describes a gas turbine engine having an annular combustor design using catalytic reactor elements in an RCL configuration. The catalytic reaction takes place in a series of annularly mounted modules, each module comprising a catalytic reactor element, a fuel injection region, a rich fuel/air mixing region, and a downstream mixing zone at the catalytic reactor element exit.

BRIEF DESCRIPTION OF THE DRAWINGS

The invention will be more apparent from the following description in view of the drawings that show.

DETAILED DESCRIPTION OF THE INVENTION

One of the challenges of gas turbine combustor design is the wide range of loading conditions over which the gas turbine engine must operate. In conventional gas turbine engine operation, the amount of fuel provided to the turbine is increased with increasing load on the turbine. Accordingly, power output of the gas turbine is primarily controlled by fuel flow to the combustor, while air flow to the combustor is kept relatively constant. As a result, a comparatively richer mixture is provided to the gas turbine under relatively higher loading conditions because of the increased fuel flow, while a leaner mixture is provided under low loading conditions because of a reduced fuel flow. Consequently, a pilot is commonly used in gas turbine combustors to form a region having a higher fuel concentration to increase flame stability at no load and low load conditions. However, because the pilot produces a diffusion flame, the pilot is a source of a significant amount of undesirable NOx. Typically, such piloted combustors may produce 5-15 ppm of NOx. Typically, 90% of the NOx emissions may be directly attributed to the pilot. Because a pilot is not needed for flame stability at relatively higher gas turbine loads, the fuel flow to the pilot may be gradually decreased as load increases until the pilot is no longer fueled. However, a volume of air flow to the pilot is typically kept constant, effectively increasing an air-fuel ratio (AFR) in the combustor as the fuel to the pilot is reduced. A resulting increased AFR may adversely affect flame stability at higher loads when the fuel flow to the pilot is reduced or stopped. The inventors of the present invention have innovatively realized that by reducing the amount of air flow provided to the pilot as the fuel flow is reduced, improved flame stability may be maintained at higher loads while reducing the NOx penalty of the pilot. The NOx penalty from the pilot is reduced because the pilot region becomes a much smaller percentage of the total combustor flow.

Figure 1:
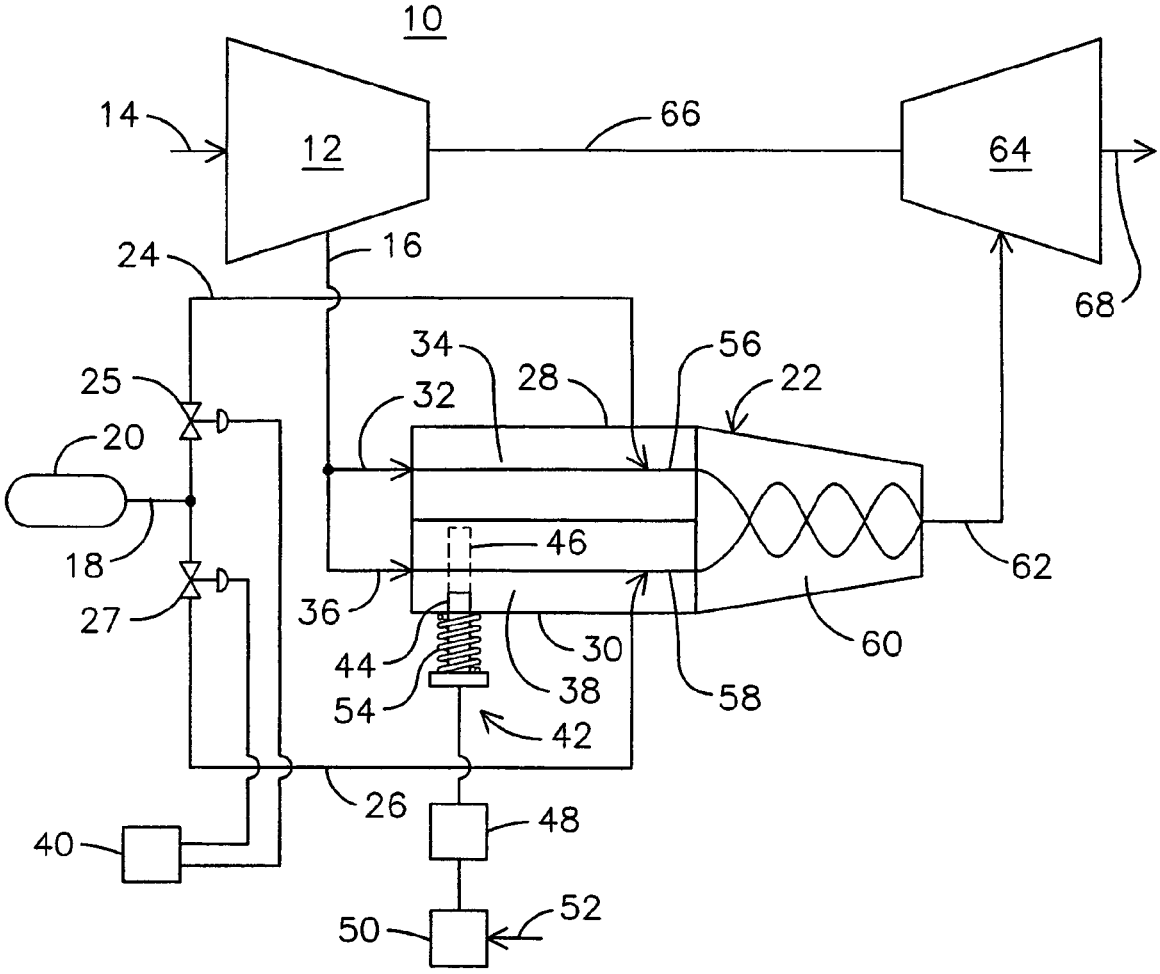
FIG. 1 is a functional diagram of a gas turbine comprising a combustor having a flow controller for controlling an amount of an oxidizer flow delivered to a pilot of the combustor.

FIG. 1 is a functional diagram of a gas turbine 10 comprising a combustor 22 having a flow controller 42 for controlling an amount of an oxidizer flow, such as a flow of compressed air 16, delivered to a pilot 30 of the combustor 22. The gas turbine 10 includes a compressor 12 for receiving a flow of filtered ambient air 14 and for producing the flow of compressed air 16. Combustible fuel 18, such as natural gas or fuel oil, is provided by a fuel source 20 to the combustor 22. A first portion 24 of the fuel 18 may be provided to a main burner 28 of the combustor 22, and a second portion 26 of the fuel 18 may be provided to the pilot 30 of the combustor 22. An amount of the first portion 24 of the fuel 18 provided to main burner 28 and an amount of the second portion 26 of the fuel 18 provided to the pilot 30 may be controlled by fuel controller 40 controlling operation of respective fuel control valves 25, 27. For example, the fuel controller 40 may be configured for controlling respective amounts of the first portion 24 and second portion 26 responsive to a load on the gas turbine 10.

A first portion 32 of the flow of compressed air 16 may be delivered to a main burner oxidizer flow path 34 of the main burner 28, and a second portion 36 of the air 16 may be delivered to a pilot oxidizer flow path 38 of the pilot 30. The first portion 24 of the fuel 18 and the first portion 32 of the air 16 may be allowed to mix in the main burner 28 to produce a main burner combustible mixture 56. The second portion 26 of the fuel 18 and the second portion 36 of the air 16 may be allowed to mix in the pilot 30 to produce a pilot combustible mixture 58. The main burner combustible mixture 56 and the pilot combustible mixture 58 are discharged from the main burner 28 and pilot 30 respectively, and allowed to mix and combust in a downstream burnout zone 60 to produce a hot combustion gas 62. The pilot 30 provides flame stability in the burnout zone 60, for example, when the gas turbine 10 is operated at reduced loads.

A turbine 64, receives hot combustion gas 62 discharged from the burnout zone 60, where it is expanded to extract mechanical shaft power. In one embodiment, a common shaft 66 interconnects the turbine 64 with the compressor 12, as well as an electrical generator (not shown) to provide mechanical power for compressing the ambient air 14 and for producing electrical power, respectively. Expanded combustion gas 68 may be exhausted directly to the atmosphere or it may be routed through additional heat recovery systems (not shown).

In an aspect of the invention, a flow controller 42 may be disposed in the pilot oxidizer flow path 38 for controlling an amount of the second portion 36 delivered to the pilot 30. In an exemplary embodiment, the flow controller 42 may include a gate valve 44 selectively positionable in the flow path 38 to control a flow of the second portion 36. The gate valve 44 may be movable from a fully open state, as indicated by the position of the gate valve 44, to a fully closed state, as indicated by the dotted line position 46 of the gate valve 44, to selectively control the amount of the second portion delivered to the pilot 30. It should be noted that other types of flow controllers, such as butterfly valves, spool valves, ball valves, and other valves used for flow control may be used. The flow controller 42 may include a biasing mechanism 54, such as a spring, to return the valve 44 to a fully open state in the absence of a valve actuating force acting to position the valve 44 away from a fully open state.

The flow controller 42 may also include an actuator 48, such as an electro-mechanical, hydraulic, or pneumatic operated mechanism, for supplying a valve actuating force to control movement of the valve 44 between the fully open and fully closed positions. The actuator 48 may be controlled by a processor 50, responsive, for example, to an operating condition of the gas turbine, such as a load on the gas turbine. The processor may receive a signal 52 indicative of the operating condition and generate appropriate commands to control the actuator to drive the valve 44 to a desired position for controlling an amount of the pilot oxidizer portion 38. For example, as a load is increased on the gas turbine 10, the valve 44 of the flow controller 42 may be gradually driven to a fully open state a no load to a fully closed state at a full, or base load. In another aspect, the position of the valve may be correlated with an amount of fuel being delivered to the pilot 30. Advantageously, the flow controller 42 allows an amount of the pilot oxidizer portion 38 to be reduced as a need for the pilot 30 to stabilize combustion is reduced. Accordingly, a desired AFR may be maintained in the downstream burnout zone 60 sufficient to achieve stable combustion over various load conditions as a piloting is reduced.

Figure 2:
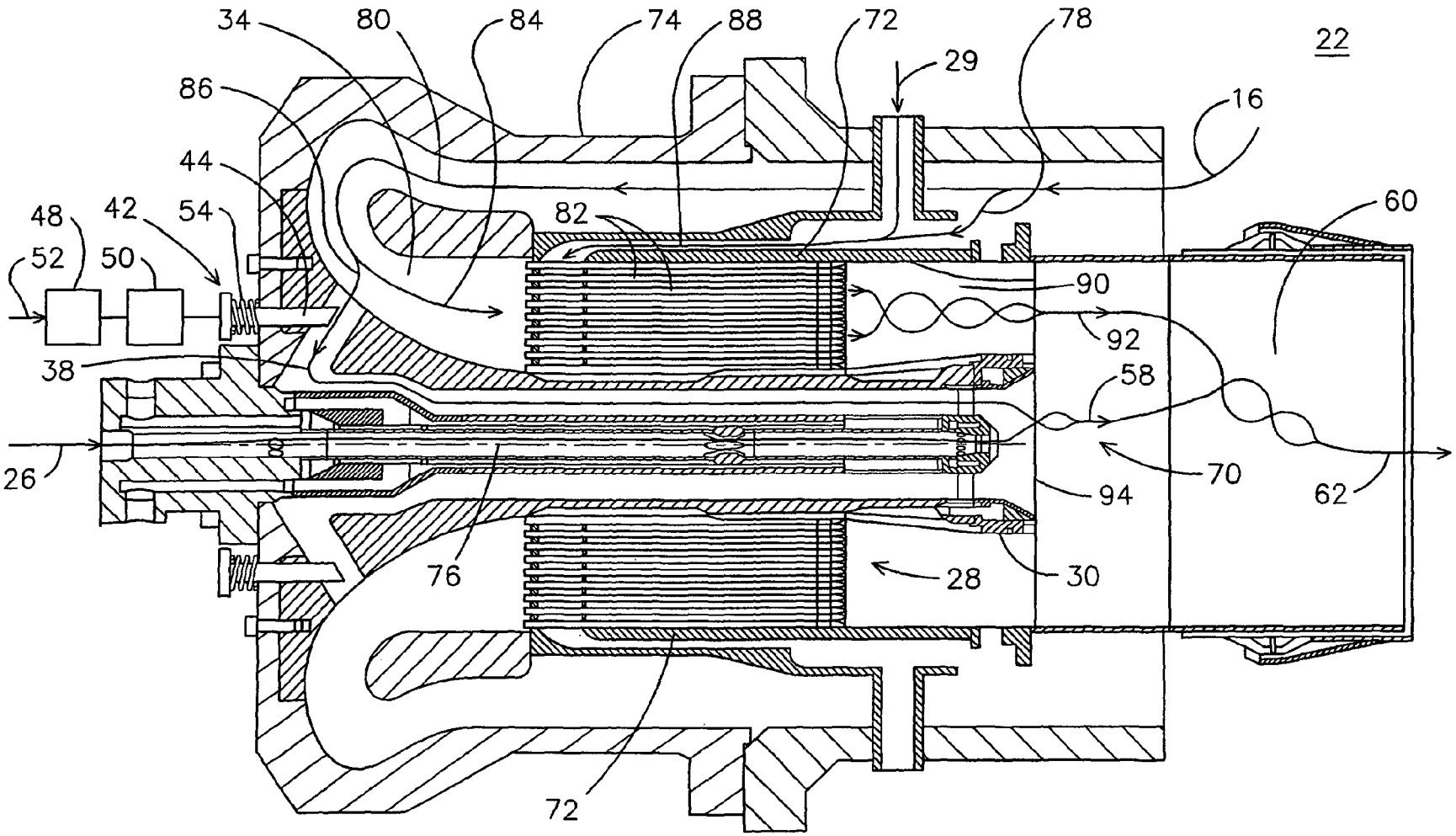
FIG. 2 illustrates a cross section of an embodiment of the gas turbine combustor of FIG. 1 comprising a catalytic combustion module.

In a catalytic combustion embodiment of the invention shown in FIG. 2, the main burner 28 of the combustor 22 is configured as an annulus having the pilot 30 disposed in a central core region 70 of the annulus. The main burner 28 includes a plurality of catalytic combustion modules 72 arranged around the central core region 70. The combustor 22 may include a combustor basket 74 having a central axis 76 for retaining the combustion modules 72 circumferentially installed in the combustor basket 74, radially outward of the central core region 70. Each catalytic combustion module 72 receives a respective catalytic combustion module portion 29 of the first portion of the fuel 18 and a combustion mixture portion 78 of the air 16 form the compressor 12 of FIG. 1.

In a backside cooling embodiment, the flow of air 16 may be split into a combustion portion 78 for mixing with the catalytic combustion module portion 29 and a backside portion 80. A first portion 84 of the backside portion 80 may be delivered to the main burner oxidizer flow path 34 of the main burner 28, and a second portion 86 of the backside portion 80 may be delivered to the pilot oxidizer flow path 38 of the pilot 30. In an aspect of the invention, a fractional amount of the of the first portion 84 delivered to the main burner 28 along the main burner oxidizer flow path 34, and a fractional amount of the second portion 86 delivered to the pilot 30 along the pilot flow oxidizer path 38 may be determined by the respective sizes of the flow paths 34, 38 and the resulting pressure drops induced along the paths 34, 38. For example, the main burner oxidizer flow path 34 and the pilot oxidizer flow path 38 may be sized so that about 94% of the backside portion 80 is directed along the main burner oxidizer flow path 34 and about 6% is directed along pilot oxidizer flow path 38.

In an embodiment of the invention, each catalytic combustion module 72 may include a plurality of spaced apart tubes 82 coated with a catalyst on respective tube outside diameter surfaces. The combustion mixture portion 78 and the catalytic combustor module portion 29 may be mixed to form a fuel/oxidizer mixture 88 directed to flow around the tubes 82 to catalytically oxidize a portion of the fuel/oxidizer mixture 46. The first portion 84 of the backside portion 80 may be conducted along the main burner oxidizer flow path 34 and directed to flow within the interior of the tubes 82 for providing backside cooling of the fuel/oxidizer mixture 88 as the mixture 88 is partially oxidized. As the first portion 84 of the backside cooling portion 80 exits each catalytic oxidation module 72 downstream, it is mixed with the fuel/oxidizer mixture 88 in a post catalytic mixing zone 90 to form a partially oxidized fuel/oxidizer mixture 92. The partially oxidized fuel/oxidizer mixture 92 is then discharged into the burnout zone 60. The second portion 24 of the fuel 18 and the second portion 86 of the backside portion 80 may be allowed to mix in the pilot 30 to produce a pilot combustible mixture 58. The pilot combustible mixture 58 is then discharged into the burnout zone 60 and allowed to mix with partially oxidized fuel/oxidizer mixture 24 and combusted in the downstream burnout zone 60 to produce the hot combustion gas 62.

In an aspect of the invention, the flow controller 42 may be disposed in the pilot oxidizer flow path 38 for controlling an amount of the second portion 86 delivered to the pilot 30. In an exemplary embodiment, the flow controller 42 may include a gate valve 44 selectively positionable in the flow path 38. The gate valve 44 may be movable from a fully open state to a fully closed state to selectively control the amount of the second portion 86 of the backside portion of the air 16 delivered to the pilot 30. In an embodiment of the invention, the valve 44 may be positioned in a fully open state to provide from about 10% to 2%, or more preferably 7% to 5%, of the second portion 86 to the pilot. In a fully closed state, the valve may be positioned to provide from about 0.75% to 0.25%, and more preferably, 0.6% to 0.4%, of the second portion 86 to the pilot 30. The flow controller 42 may include biasing mechanism 54 to return the valve 44 to a fully open state in the absence of a valve actuating force acting to position the valve 44 away from a fully open state.

The flow controller 42 may also include an actuator 48 supplying a valve actuating force to control movement of the valve 44 between the fully open and fully closed positions. The actuator 48 may be controlled by the processor 50, responsive, for example, to an operating condition of the gas turbine. The processor 50 may receive a signal 52 indicative of the operating condition and generate appropriate commands to control the actuator to drive the valve 44 to a desired position for controlling an amount of the second portion 86 provided to the pilot 30. Advantageously, the flow controller 42 allows the amount of the second portion 86 to be reduced as the need for the pilot 30 to stabilize combustion is reduced, such as when the gas turbine is operated at base load. Accordingly a desired AFR may be maintained in the downstream burnout zone 60 when the second portion 26 delivered to the pilot is reduced, for example, at higher loads. In a further aspect, a reduced amount of air flow may be provided to the pilot 30 even when no fuel is being provided to enhance mixing in the central region 70 downstream of the pilot outlet 94 to limit dead zone formation that may adversely affect combustion stability.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. A combustor for a gas turbine comprising:

a main burner oxidizer flow path delivering a first portion of an oxidizer flow to a main burner of a gas turbine combustor;

a pilot oxidizer flow path delivering a second portion of the oxidizer flow to a pilot of the combustor;

a flow controller disposed in the pilot oxidizer flow path for controlling an amount of the second portion delivered to the pilot;

a pilot fuel flow for delivering fuel to the pilot; and a flow controller actuator controlling a position of the flow controller responsive to an operating condition of the gas turbine;

wherein the flow controller comprises a plurality of maintainable open positions between a fully opened state and a fully closed state; and wherein the position of the flow controller is correlated with the amount of fuel to the pilot; and wherein the flow controller actuator is configured to selectively reduce the amount of the second portion delivered to the pilot via maintenance of a position of the flow controller at one of the plurality of maintainable open positions between the fully opened state and the fully closed state as an amount of fuel delivered to the pilot is reduced.

2. The combustor of claim 1, wherein the main burner oxidizer flow path comprises a catalytic module.

3. The combustor of claim 1, wherein the flow controller actuator is configured to control the position of the flow controller in response to an operating condition of the gas turbine.

4. The combustor of claim 3, wherein the operating condition comprises a load on the gas turbine.

5. The combustor of claim 3, further comprising a processor receiving a signal indicative of the operating condition and generating a command to control the flow controller actuator responsive to the signal.

6. The combustor of claim 1, wherein the flow controller actuator comprises a hydraulically operated mechanism.

7. The combustor of claim 1, wherein the flow controller actuator comprises a pneumatically operated mechanism.

8. The combustor of claim 1, wherein the flow controller further comprises a biasing mechanism to return the flow controller to the fully opened state in the absence of a flow controller actuating force acting to position the flow controller away from the fully opened state.

9. The combustor of claim 1, wherein the oxidizer flow comprises a combustible fuel.

10. The combustor of claim 1, wherein the flow controller comprises a valve selected from the group consisting of a gate valve, a butterfly valve, a ball valve, and a spool valve.

11. A gas turbine engine comprising the combustor of claim 1.

12. The combustor of claim 1 used to implement a method of controlling combustion comprising: delivering the first portion to the main burner; delivering the second portion of the oxidizer flow to the pilot; and controlling an amount of the second portion delivered to the pilot.

13. A method of controlling combustion in a gas turbine comprising:

delivering a first portion of an oxidizer flow to a main burner of a gas turbine combustor;

delivering a second portion of the oxidizer flow to a pilot of the combustor;

controlling an amount of the second portion delivered to the pilot;

delivering an amount of fuel to the pilot; and controlling an amount of oxidizer delivered to the pilot via a flow controller comprising a plurality of maintainable open positions between a fully opened state and a fully closed state;

wherein the position of the flow controller is correlated with the amount of fuel to the pilot; and wherein the controlling an amount of the second portion delivered to the pilot comprises selectively reducing the amount of the oxidizer flow delivered to the pilot via maintaining a position of the flow controller at one of the plurality of maintainable open positions between the fully opened state and the fully closed state as the amount of fuel delivered to the pilot is reduced.

14. The method of claim 13, further comprising controlling the amount of the second portion delivered to the pilot responsive to an operating condition of the gas turbine.

15. The method of claim 14, wherein the operating condition comprises a load on the gas turbine.

16. The method of claim 13, wherein the flow controller is disposed in a pilot oxidizer flow path conducting the second portion of the oxidizer flow, and wherein controlling the amount of the second portion delivered to the pilot comprises controlling the position of the flow controller disposed in the pilot oxidizer flow path.

17. The method of claim 16, further comprising positioning the flow controller in the fully opened state to provide an amount of the second portion delivered to the pilot comprising about 10% to 2% of the oxidizer flow.

18. The method of claim 16, further comprising positioning the flow controller in the fully opened state to provide an amount of the second portion delivered to the pilot comprising about 7% to 5% of the oxidizer flow.

19. The method of claim 16, further comprising positioning the flow controller in the fully closed state to provide an amount of the second portion delivered to the pilot comprising about 0.75% to 0.25% of the oxidizer flow.

20. The method of claim 16, further comprising positioning the flow controller in the fully closed state to provide an amount of the second portion delivered to the pilot comprising about 0.6% to 0.4% of the oxidizer flow to the pilot.

21. The method of claim 13, wherein the main burner comprises a catalytic combustion module.

22. The method of claim 13, further comprising simultaneously allowing flow of the oxidizer flow to each of the main burner and the pilot.

23. The combustor of claim 1, wherein the flow controller is configured to simultaneously enable flow of the first portion to the main burner oxidizer flow path and flow of the second portion to the pilot oxidizer flow path.

* * * * *